US009420834B2

(12) United States Patent
Baxter et al.

(10) Patent No.: US 9,420,834 B2
(45) Date of Patent: Aug. 23, 2016

(54) ABRASIVE RESISTANT GARMENT

(75) Inventors: Megan K. Baxter, Denver, NC (US); Bridgot Isenhour, Lincolnton, NC (US)

(73) Assignee: Proudest Monkey, LLC, Minneapolis, MN (US)

( * ) Notice: Subject to any disclaimer, the term of this patent is extended or adjusted under 35 U.S.C. 154(b) by 465 days.

(21) Appl. No.: 11/775,386

(22) Filed: Jul. 10, 2007

(65) Prior Publication Data

US 2009/0013451 A1 Jan. 15, 2009

(51) Int. Cl.

| | |
|---|---|
| ***A62B 17/00*** | (2006.01) |
| ***A41D 13/015*** | (2006.01) |
| ***A41D 1/06*** | (2006.01) |
| ***A41D 13/05*** | (2006.01) |
| ***A41B 9/00*** | (2006.01) |
| ***A41D 13/06*** | (2006.01) |
| ***A41F 17/04*** | (2006.01) |
| ***A41B 9/12*** | (2006.01) |
| *A41D 13/00* | (2006.01) |

(52) U.S. Cl.

CPC ..... *A41D 13/0537* (2013.01); *A41B 9/001* (2013.01); *A41B 9/12* (2013.01); *A41D 13/065* (2013.01); *A41F 17/04* (2013.01); *A41D 2600/102* (2013.01)

(58) Field of Classification Search

CPC ..... A41D 13/05; A41D 13/0543; A41D 31/0061; A41D 13/0537; A41D 1/06; A41D 31/00; A41D 13/00; A41D 13/0002; A41D 13/02; A41D 13/065; A41D 19/0096; A41D 1/067; A41D 2600/102

USPC ..... 2/445, 456, 459, 460, 461, 462, 463, 2/464, 465, 466, 467, 2.5, 22, 23, 24, 46, 2/79, 227, 243.1, 69

See application file for complete search history.

(56) References Cited

U.S. PATENT DOCUMENTS

| | | | | |
|---|---|---|---|---|
| 2,134,939 | A | 11/1938 | Goodenow | |
| 2,589,636 | A * | 3/1952 | Smith | 2/459 |
| 2,790,973 | A | 5/1957 | Lewis, Jr. et al. | |
| 3,191,185 | A * | 6/1965 | Martin | 2/22 |

(Continued)

FOREIGN PATENT DOCUMENTS

| | | |
|---|---|---|
| CA | 2231549 | 4/1997 |
| CA | 2343707 A1 | 10/2001 |

(Continued)

OTHER PUBLICATIONS

Webster's dictionary, "undergarment".*

(Continued)

*Primary Examiner* — Bobby Muromoto, Jr.

(74) *Attorney, Agent, or Firm* — Womble Carlyle Sandridge & Rice LLP; Jacob S. Wharton

(57) ABSTRACT

A protective undergarment having reinforced areas in particular locations, such as the knees and seat is provided. The garment, and particularly each of the pair of legs of the garment, is made of an abrasive resistant fabric, such as aramid fibers, in particular, KEVLAR®, and is preferably made in a woven or knitted pattern so as to be soft to the touch and breathable so that the garment is comfortable to wear under clothing. Stirrups may be attached at the bottom of each leg to prevent movement of the reinforced areas in the event of a fall.

19 Claims, 2 Drawing Sheets

(56) References Cited

U.S. PATENT DOCUMENTS

| | | | | | |
|---|---|---|---|---|---|
| 3,200,414 | A | * | 8/1965 | Sternberg | 2/232 |
| 3,209,370 | A | * | 10/1965 | Miller | 2/232 |
| 3,250,095 | A | * | 5/1966 | Bird | 66/178 R |
| 3,262,127 | A | * | 7/1966 | Williamson | 2/232 |
| 4,117,552 | A | * | 10/1978 | Simpson | 2/2.14 |
| 4,280,342 | A | * | 7/1981 | Eng et al. | 66/177 |
| 4,351,065 | A | * | 9/1982 | Bouchard | 2/23 |
| 4,987,613 | A | * | 1/1991 | Loverdi et al. | 2/23 |
| 5,014,354 | A | | 5/1991 | Dumont | |
| 5,090,053 | A | | 2/1992 | Hayes | |
| 5,095,544 | A | * | 3/1992 | Elverskog | 2/22 |
| 5,224,363 | A | * | 7/1993 | Sutton | 66/202 |
| 5,267,354 | A | * | 12/1993 | Grilliot et al. | 2/23 |
| 5,415,007 | A | * | 5/1995 | Eng | 66/192 |
| 5,625,895 | A | * | 5/1997 | Sovereign | 2/467 |
| 5,636,387 | A | | 6/1997 | Lundy | |
| 5,766,746 | A | | 6/1998 | Kampl et al. | |
| 5,887,453 | A | | 3/1999 | Woods | |
| 5,918,319 | A | | 7/1999 | Baxter | |
| 6,453,791 | B1 | | 9/2002 | Seitzinger | |
| 6,589,891 | B1 | * | 7/2003 | Rast | 442/1 |
| 6,666,235 | B2 | * | 12/2003 | Chi et al. | 139/420 A |
| 6,810,534 | B2 | * | 11/2004 | Durkin et al. | 2/267 |
| 7,043,766 | B1 | | 5/2006 | Foreman et al. | |
| D558,953 | S | * | 1/2008 | Rogers et al. | D2/742 |
| 2001/0009830 | A1 | * | 7/2001 | Baychar | 442/118 |
| 2002/0069453 | A1 | * | 6/2002 | Kelleher et al. | 2/458 |
| 2002/0123284 | A1 | * | 9/2002 | Zhu | 442/199 |
| 2003/0167557 | A1 | | 9/2003 | LaShoto et al. | |
| 2004/0019950 | A1 | | 2/2004 | Rast | |
| 2005/0067816 | A1 | | 3/2005 | Buckman | |
| 2005/0144698 | A1 | * | 7/2005 | Vito et al. | 2/161.1 |
| 2006/0000005 | A1 | | 1/2006 | Foreman et al. | |
| 2006/0042326 | A1 | | 3/2006 | Hubner | |
| 2006/0048496 | A1 | | 3/2006 | Waggett et al. | |
| 2006/0162043 | A1 | | 7/2006 | Angus | |
| 2006/0213173 | A1 | | 9/2006 | Kolmes et al. | |

FOREIGN PATENT DOCUMENTS

| | | |
|---|---|---|
| JP | 2004115970 | 4/2004 |
| WO | WO2008/142451 A2 | 11/2008 |

OTHER PUBLICATIONS

Extended European Search Report and Opinion dated Mar. 22, 2013 from corresponding EP Application No. 08780077.7, 6 pages.

Australian Patent Office, Innovation Patent Examination Report No. 1 for App. No. AU 2014100824, dated Oct. 13, 2014.

Canadian Patent Office, Examiner's Requisition Application No. 2,695,081, dated Aug. 6, 2015.

* cited by examiner

ABRASIVE RESISTANT GARMENT

FIELD OF INVENTION

This invention relates to an abrasive resistant garment. In particular, this invention relates to an abrasive resistant garment worn by motorcyclists for protection against skin abrasion in the event of a motorcycle accident.

BACKGROUND

The present invention is directed to an abrasive resistant garment that would typically be worn by motorcyclists as a form of protection against abrasion in the event of an accident. Other forms of protective clothing exist to help motorcyclists protect themselves from abrasion in the event of an accident or fall. These include leather apparel. Thick leather garments are effective in guarding against abrasion. But leather garments are heavy and do not provide any air flow between the user's skin and the exterior. Thus, it is uncomfortable for a motorcyclist to wear thick leather garments for any length of time or during warmer weather.

There are alternative materials that are presently used by motorcyclists to prevent abrasion. These include man-made materials that are made into garments. Materials including ballistic nylon, CORDURA®, GORE-TEX® and KEVLAR® have been incorporated into cloth garments to increase the resistance of such garments. A material such as CORDURA®, a high strength-to-weight ratio fabric that is flat/textured, light weight/heavy weight, and/or nylon/polyester based, is a man-made fabric often made into garments. A material, such as GORE-TEX®, a multi-layer high performance abrasion resistant and breathable fabric, is often made into garments. A material, such as KEVLAR®, a light, strong para-amide synthetic fiber, is often made into protective garments. However, as a weave of different materials, they require a significant thickness in order to be effective against abrasion. Moreover, some weaves are not as effective where they are combined with natural materials that provide little or no abrasion resistance.

There have been other improvements in the area of safety garments for preventing abrasion. One such patent (U.S. Pat. No. 5,918,319) is directed to an abrasive resistant fabric. The fabric is made of high performance fiber, such as KEVLAR®, terried on the face side of a fabric at certain locations within a garment to provide abrasion resistance at those locations. For example, the abrasive resistant fabric is woven into areas in a garment to protect the knees and lower torso on a pair of pants, and at the elbows and shoulders on a jacket. While this type of 25 garment is effective in resisting abrasion, it is heavy and is not conducive to wearing in warmer weather. This patent is hereby incorporated herein by reference in its entirety.

In addition, another problem with some abrasive resistant safety garments is that some tend to shift during an accident which may result in the protected areas moving and exposing skin to the street surface. This could result in serious abrasions on a substantial portion of the user's skin that the garment was intended to protect. Thus, it is important that during a fall from a motorcycle, any abrasion resistant garment must not shift and remain substantially in place to protect the areas designed to be protected. One way to achieve such a goal is to ensure that the garment is adjacent to the skin and that the area to be protected is sufficiently surrounded by abrasion resistant material during an accident. Moreover, a garment may be designed to prevent movement during a fall.

Some undergarments provide the ability to cover a significant amount of the wearer's skin effectively. In particular, long underwear covers a considerable amount of the user's skin while not shifting in any significant fashion. At present, there is no undergarment that is light weight and breathable that is also effective at abrasion resistance.

Thus, there is a need for an undergarment that can be comfortably worn, yet provide effective abrasion resistance.

There is a further need to provide a light weight undergarment that effectively resists abrasion.

There is still a further need to provide a breathable undergarment that is also abrasion resistant.

There is yet a further need to provide an undergarment that may be comfortably worn by the user and will not significantly shift during a fall from a motorcycle.

There is yet a further need to provide an undergarment that provides effective abrasion resistance to certain areas of the body most susceptible to abrasion during a fall or accident.

SUMMARY

The present invention is directed to a protective undergarment pants made entirely of abrasive resistant fabric and having reinforced areas in fixed locations. The garment may be pants or a single union suit that includes a pant portion integral with a shirt portion. Further, the garment may include a connection means so that the undergarment pant may be secured to a shirt with buttons, zippers, pins or the like. Where the protective undergarment is a pair of pants, the reinforced areas may include the knee areas and/or the seat. Where the protective undergarment is a pair of pants, the undergarment may further include stirrups located at the bottom of each leg of the pants. The undergarment is made of aramid fibers that are proven to be abrasion resistant, one such fiber is known as KEVLAR®. Further the undergarment material is woven or knitted in such a way to create a light-weight, breathable fabric that is comfortable to wear under clothing.

Applicant has studied abrasion injuries of motorcyclists and found that certain areas of the lower body are more susceptible to abrasion injury or burn than others. In particular, in a motorcycle accident or fall, the motorcyclist is most likely to suffer serious abrasive injuries to his or her knee and seat areas. Studies have shown that in motorcycle accidents, drivers and passengers of motorcycles roll and skid when ejected from a motorcycle. The areas in which they skid or most likely to abrade their bodies are at the knee and on the bottom. Thus, it is critical in designing an abrasive resistant undergarment pant that the knee and seat area have sufficient reinforcement to prevent such injuries.

Applicant has designed the reinforced area of the undergarment to ensure that the intended areas of protection will be covered by reinforced fabric in the event of an accident or fall. In particular, in the knee area, applicant has designed the reinforced knee area to compensate for standard variations in knee locations as well as standard variations in leg length. Furthermore, applicant has designed the reinforced knee area to be wide enough to cover the knee area in the event of a fall and in the event of slight slippage or movement of the fabric upon impact of the motorcyclist with the road surface.

In similar fashion, applicant has designed the reinforced seat area to ensure that the reinforced seat area will cover the seat area of the wearer in the event of a fall or accident. The seat area is dimensioned to cover standard variations in seat length and width of the particular size and gender of the wearer. The reinforced seat area also includes a width margin that ensures that allows for slight slippage or movement of the reinforced seat area when the wearer hits the road surface.

Features and advantages of the present invention will become more apparent in light of the following detailed description of some embodiments thereof, as illustrated in the accompanying figures. As will be realized, the invention is capable of modifications in various respects, all without departing from the spirit and scope of the invention. Accordingly, the drawings and the description are to be regarded as illustrative in nature, and not as restrictive.

DESCRIPTION

Figure 1:
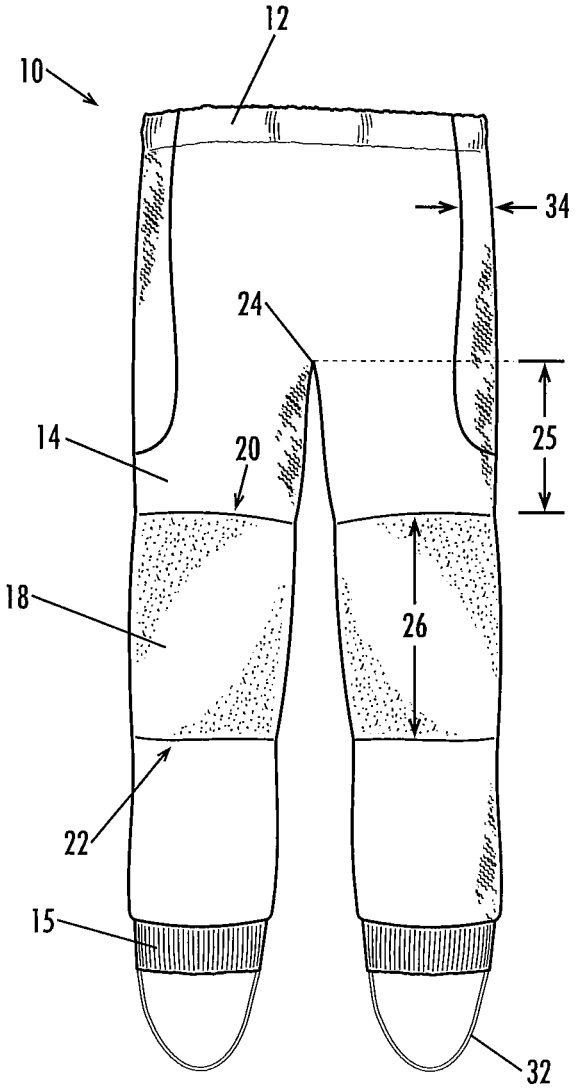
FIG. 1 is a front view of the present invention showing the reinforced areas.

An embodiment of the present invention for a protective garment is shown in FIG. 1. The embodiment is a pair of undergarment pants shown generally as 10. The pants 10 include a waistband 12 and two legs 14. The waistband 12 may be elasticized to provide further comfort to the user. Alternatively, the waist may be adjustable with a drawstring, buttons, or the like.

The undergarment 10 is made of a single material and reinforced along the garment at certain locations. The reinforced areas have a double layer of material. The garment material is preferably made of 100% aramid fibers, preferably KEVLAR®. The aramid fiber threads are woven or knitted. The aramid fiber material provides significant resistance to abrasion and the weave or knit, as previously disclosed, provides a strong material in a light weight, breathable textile that is comfortable to wear.

It is contemplated that the garment may be made of multiple layers where the reinforced areas have a great number of layers than the remaining areas of the garment. Further it is contemplated that while a single layer garment may be light weight and breathable, a double or multi-layered garment may provide additional thermal insulation for wear in colder climates or in winter months.

Figure 2:
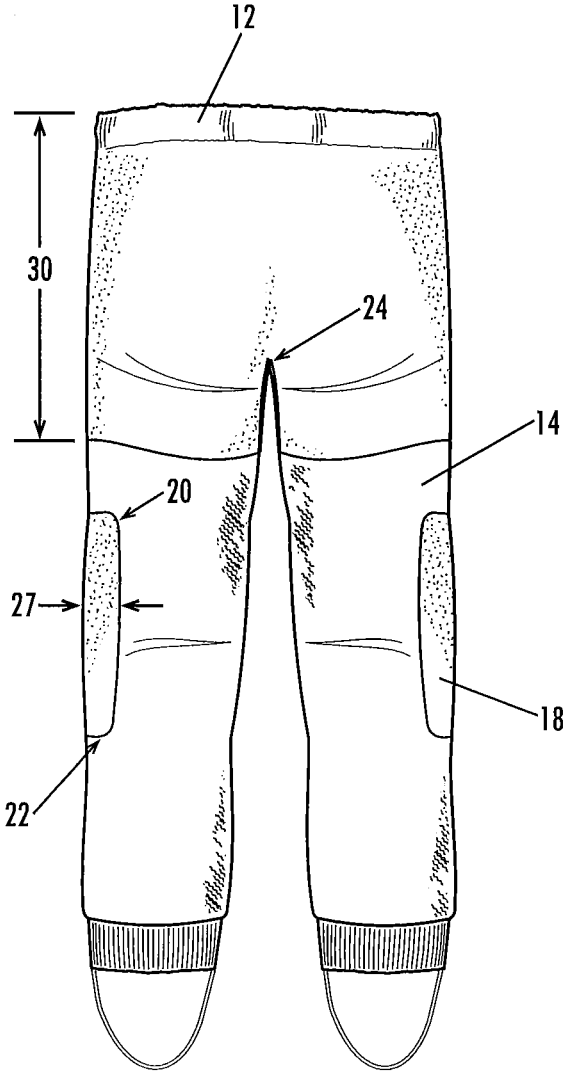
FIG. 2 is a rear view of the present invention of FIG. 1.

Each leg 14 of the pant 10 is reinforced in the knee area 18. The reinforced knee area has a top edge 20 and a bottom edge 22. The reinforced knee area 18 begins at a distance from the start of the inseam 24 and extends down the leg to the bottom edge 22 of the reinforced knee area. The measurement between the start of the inseam 24 and the top of the reinforced knee area 18 is designated as 25. The length of the reinforced knee area 18 is designated as 26. In a preferred embodiment, the length 26 of the reinforced knee area 18 is twelve (12) inches for a standard unisex undergarment pant having a waist size of between 32 and 34 inches. Further, for this same size range, it is preferred that the measurement from the start of the inseam 24 to the top edge 20 of the reinforced knee area 18, designated as 25, is ten (10) inches. In addition, the reinforced knee area 18 has a width greater than the width of the leg 14. As seen in FIG. 2, the reinforced knee area 18 extends beyond the front of each leg and extends beyond the side seam. The width of the extension is designated by 27. In a preferred embodiment for a standard unisex undergarment pant having a waist size of between 32 and 34 inches, the width 27 of the reinforced knee area 18 should extend to the back of the leg by about two inches.

At the bottom of each leg 14 is an elasticized leg cuff 15. The cuff 15 serves to hold the bottom of the leg 14 of the garment 10 close to the body of the wearer. In addition, the garment 10 has a pair of stirrups 32. The stirrups 32 are located at the bottom of each leg cuff 15 and attached adjacent to the inseam 24 and on the opposing side of the lower leg. In use, the stirrups 32 are designed to sit on the bottom of the wearer's feet and hold the leg 14, including the reinforced knee area 18 and seat area 28 of the garment taught when it is being worn. In particular, the stirrups 32 help to secure the leg 14 and the reinforce knee area 18 and seat area 28 in place while the garment 10 is worn and in the event of a fall or accident. The stirrups 32 are preferably made of an elasticized material that stretch to accommodate different sizes and allows some movement of the garment during use while ensuring that the reinforced areas remain in place. Because most wearers would also wear leather boots, it is not necessary to make the elasticized stirrup 32 out of an abrasive resistant material. The stirrup would likely rest inside of the wearer's boot and would be safe from any potential abrasion in the event of an accident or fall.

FIG. 2 is a rear view of the embodiment of the present invention. The undergarment of the present embodiment is reinforced in the seat area 28. The reinforced seat area 28 includes a second layer of fabric. The reinforced seat area 28 begins at the top of the waistband 12 and extends down the pant leg to a location below the start of the inseam 24. The length of the seat reinforced area 28 is indicated by 30. For a size of a unisex undergarment pant that fits someone having a waist of about 32 to 34 inches, it is preferred that the length 30 be about 15.5 inches. In addition, for the same size, it is preferred that the length 30 of the reinforced seat area 28 continue past the start of the inseam by about three (3) inches. In addition, the reinforced seat area 28 extends beyond the outer side seam. The width of the reinforced seat area 28 that extends beyond the side seam is indicated generally at 34. For a size of a unisex undergarment pant that fits a person having a waist of about 32 to 34 inches, the width 34 of the reinforced seat area 28 that extends beyond the side seam is preferably about 3.25 inches.

Figure 3:
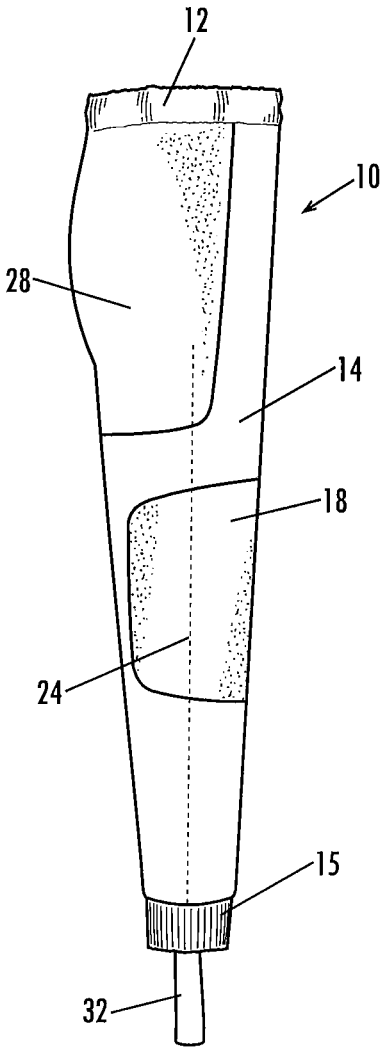
FIG. 3 is a right side view of the present invention of FIG. 1.

FIG. 3 is a right side view of the embodiment of the present invention. The reinforced seat area 28 can be seen in FIG. 3 as well as the reinforced knee area 18.

It should be further understood by those skilled in the art that the foregoing modifications as well as various other changes, omissions and additions may be made without parting from the spirit and scope of the present invention. For example, while some dimensions have been provided, it is understood that those dimensions are given as those for a particular sized person. Other garments may be differently dimensioned so as to fit different sized wearers of the garments. For example, a unisex undergarment pant that is sized to fit a standard person having a waist of about 40 to 42 inches, would likely have some dimensions that are larger than those described above for a person's undergarment pant that fits a standard person having a waist of about 32 to 34 inches. Similarly, a person's undergarment pant that is sized to fit a standard person having a waist of about 28 to 30 inches, would likely have some dimensions that are smaller than those described above for a person's undergarment pant that fits a standard person having a waist of about 32 to 34 inches. It is appreciated by those skilled in the art that the proportional dimensions of different adult sizes would vary in proportion to the dimensions provided therein. For example, a person's extra large size would be proportionately larger than a person's large size (having a waist size of 40 to 42 inches) provided herein Thus, while applicant has provided a variety of dimensions according to different adult sizes, it is understood that those skilled in the art would know that the dimensions of a larger adult would be proportionately larger. Similarly, the dimensions of a smaller person would be proportionately smaller than those provided herein.

Furthermore, it is anticipated that a person of skill in this art would appreciate that the dimensions provided herein may be altered to accommodate a garment designed to fit a child. The dimensions provided may be scaled down to fit a child. Moreover, children's sizes would vary similarly as the adult sizes described herein would vary depending upon the standard sizes of the industry.

It is further envisioned in the present invention that while children's sized garments may be used as abrasive resistant clothing for use in riding as passengers on motorcyclists, it is also envisioned that the present invention may be used by children and adults for preventing abrasion related injuries that commonly occur in cycling, skate boarding and other sports.

Certain terminology is used herein for convenience only and is not to be taken as a limitation on the invention. For example, words such as "top," "bottom," "upper," "lower," "horizontal," "vertical," "inner," "outer," "upward," and "downward" merely describe the configuration shown in the figures. It is understood that the reference items may be oriented in any direction and the terminology, therefore, should be understood as encompassing such variations unless specified otherwise.

We claim:

1. A protective long underwear undergarment consisting of a pant having an inseam, a waistband, a seat and a pair of legs, each of the pair of legs having an outer leg seam, said pant being made of at least one layer of abrasive resistant fabric;

said pant further comprising a layer of abrasive resistant fabric forming a reinforced knee area, said reinforced knee area having a top edge and a bottom edge, said top edge disposed at a predetermined distance below said inseam;

said pant further comprising a layer of abrasive resistant fabric forming a reinforced seat area, said reinforced seat area extending from said waistband and past said inseam; and said reinforced knee area and said reinforced seat area and said pant consisting of said abrasive resistant fabric, wherein said abrasive resistant fabric consists of aramid fibers.

2. The protective long underwear undergarment of claim 1 wherein said reinforced knee area is located approximately midway along the length of each leg.

3. The protective long underwear undergarment of claim 2 wherein the top of said reinforced knee area is located along each leg front between about 8 and about 12 inches from the start of the inseam for a garment sized to fit a standard adult having a waist of between 28 and 42 inches.

4. The protective long underwear undergarment of claim 3 wherein said reinforced knee area measures between about 10 and about 13 inches in length.

5. The protective long underwear undergarment of claim 4 wherein said reinforced knee area extends beyond the leg front outer side seam by between 1 and 5 inches.

6. The protective long underwear undergarment of claim 1 wherein said reinforced seat area is located in the seat of the pants.

7. The protective long underwear undergarment of claim 6 wherein said reinforced seat area extends from the start of the inseam down the back of each pant leg for between about 1 to 6 inches for an undergarment sized to fit a standard adult having a waist of between 28 and 42 inches.

8. The protective long underwear undergarment of claim 7 wherein said reinforced seat area has a top that is located at the top of a waistband of the undergarment.

9. The protective long underwear undergarment of claim 8 wherein the length of the side seam of said reinforced seat area is between about 12 and about 17 inches.

10. The protective long underwear undergarment of claim 1 wherein the undergarment has stirrups attached to the bottom of each leg of the pant.

11. The protective long underwear undergarment of claim 10 wherein the stirrups are made of an elasticized material.

12. The protective long underwear undergarment of claim 1 wherein the fabric is woven or knitted.

13. The protective long underwear undergarment of claim 1, further comprising a cuff connected to the bottom of each of the pair of legs of the undergarment.

14. The protective long underwear undergarment of claim 1, wherein each of said pair of legs is made of at least two layers of abrasion-resistant fabric.

15. The protective long underwear undergarment of claim 1, where said at least one reinforcement area comprises a plurality of layers of reinforcement fabric.

16. The protective long underwear undergarment of claim 1, further comprising means for connecting the undergarment to a shirt.

17. The protective long underwear undergarment of claim 16, wherein said means comprise buttons, zippers or pins for connecting the undergarment to a shirt.

18. The protective long underwear undergarment of claim 1, wherein said reinforced knee area comprises an extension that extends beyond said outer leg seam and is wider than the width of the leg.

19. The protective long underwear undergarment of claim 1, wherein the reinforced seat area extends beyond the side seam to a front of each of said pair of pant legs.

* * * * *